United States Patent [19]

Fujiwara et al.

[11] 4,219,356

[45] Aug. 26, 1980

[54] MACHINABLE FERRITIC STAINLESS STEELS

[75] Inventors: Tatsuo Fujiwara, Nagoya; Shozo Abeyama; Kiyohito Ishida, both of Agui; Sadayuki Nakamura, Chita, all of Japan

[73] Assignee: Daido Tokushuko Kabushiki Kaisha, Nagoya City, Japan

[21] Appl. No.: 942,138

[22] Filed: Sep. 13, 1978

[30] Foreign Application Priority Data

Sep. 20, 1977 [JP] Japan ..... 52-112158

[51] Int. Cl.[2] ..... C22C 38/22; C22C 38/60; C22C 39/16

[52] U.S. Cl. ..... 75/126 L; 75/126 M; 75/126 C; 75/126 R; 148/37

[58] Field of Search ..... 75/126 L, 126 M, 126 R, 75/126 C; 148/37

[56] References Cited

U.S. PATENT DOCUMENTS

| | | | |
|---|---|---|---|
| B 416,399 | 1/1975 | Denhard, Jr. et al. | 75/126 L |
| 3,846,186 | 11/1974 | Tipnis | 75/126 L |
| 3,928,088 | 12/1975 | Schlosser et al. | 75/126 L |

FOREIGN PATENT DOCUMENTS

| | | | |
|---|---|---|---|
| 46-30932 | 6/1967 | Japan | 75/126 L |
| 1106501 | 3/1968 | United Kingdom | 75/126 L |

OTHER PUBLICATIONS

Carpenter Project '70, 182–FM (S18200) (6/76).

*Primary Examiner*—L. Dewayne Rutledge
*Assistant Examiner*—Upendra Roy
*Attorney, Agent, or Firm*—Fleit & Jacobson

[57] ABSTRACT

Machinable ferrite stainless steels having an excellent corrosion resistance, consisting of not more than 0.030% of C, not more than 0.050% of N, not more than 0.012% of O, not more than 0.8% of Si, not more than 1.6% of Mn, 0.05–0.40% of S, 16–22% of Cr, and 1–3% of Mo, or at least one of 0.03–0.25% of Pb, 0.03–0.20% of Se and 0.01–0.15% of Te, the remainder being Fe, provided that the sum of C and N is not more than 0.060% and Mn/S is 2–5, characterized by that Cr content based on 100 parts by weight of sulfide inclusions formed in the said steels is 10–50 parts by weight.

1 Claim, 3 Drawing Figures

Sample NO. 7

Sample NO. C

Sample NO. G

MACHINABLE FERRITIC STAINLESS STEELS

Figure 1:
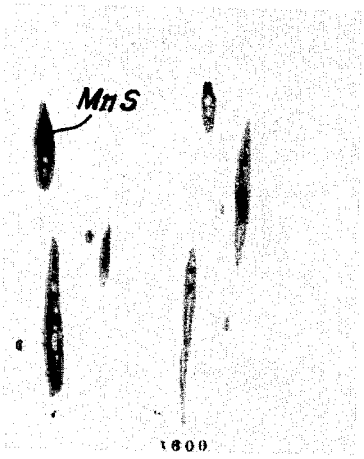

The present invention relates to 18Cr-2Mo type of machinable ferrite stainless steels having an excellent corrosion resistance.

Conventional 18Cr-2Mo stainless steel corresponds to SUS 316 stainless steel, nickel component in which is substituted with molybdenum, so that said stainless steel is more cheap than SUS 316 and is far more excellent in the stress corrosion cracking resistance than SUS 304 and SUS 316 and is equal in the pitting corrosion resistance against a neutral solution such as marine water to SUS 304 but is poor in the corrosion resistance against inorganic acids, such as sulfuric acid and hydrochloric acid.

The machinability of ferrite stainless steels is somewhat superior to that of the other stainless steels but are fairly inferior to AISI 1212 steel (low carbon sulfur steel) which is the indication of judgement of machinability. Therefore, there is an embodiment wherein Sand Se are contained. AISI 430F Se which has been intended to improve the machinability of stainless steels has the drawback that the inherent corrosion resistance is deteriorated.

Furthermore, the machinable 18Cr-2Mo type of stainless steel UNILOY 18-2FM having an excellent corrosion resistance has been known and Alloy Digest, SS-312 (June, 1975) discloses that the composition of said steel consists of not more than 0.08% of C, not more than 1.50%, of Mn, not more than 0.04% of P, not less than 0.15% of S, not more than 1.00% of Si, 18.00–19.00% of Cr, 1.75–2.25% of Mo and the remainder being Fe.

Furthermore, this publication discloses that UNILOY 18-2FM has the tool life of about 1.5 times as long as AISI 303 and of about 1.3 times as long as AISI 416.

There is described that the corrosion resistance of UNILOY 18-2FM is equal or somewhat superior to that of AISI 303 and is far more excellent than that of AISI 416 and for example, the resistance of UNILOY 18-2FM against the chloride stress-corrosion cracking and pitting corrosion is superior to that of AISI 303 and the resistance against 5% salt spray exposure is better.

However, 18Cr-2Mo stainless steel in which only sulfur is contained in order to improve the machinability, is satisfactorily excellent in the machinability but it has not been avoided to lower the corrosion resistance owing to containing the elements for improving the machinability.

The present invention proposes the effective means for solving the above described problems.

It has been found that in 18Cr-2Mo type of machinable ferrite stainless steels containing the elements for improving the machinability, such as S, Pb, Se and Te, the contents of C, N and O in the steels are allowed to be slight, Mn/S ratio in the alloy components is defined to be within the range of 2–5 and Cr content based on 100 parts by weight of sulfide inclusions, such as (Mn, Cr)S, (Mn, Cr)S+Pb, (Mn, Cr) (S, Se) and (Mn, Cr)S+MnTe formed in the steels is made to be 10–50 parts by weight, whereby the lowering of the corrosion resistance is prevented or the corrosion resistance is improved.

The first aspect of the present invention is to provide machinable ferrite stainless steels consisting of not more than 0.030% of C, not more than 0.050% of N, not more than 0.012% of O, not more than 0.8% of Si, not more than 1.6% of Mn, 0.05–0.40% of S, 16–22% of Cr, 1–3% of Mo, the remainder being Fe, provided that the sum of C and N is not more than 0.060% and Mn/S is 2–5, characterized by that Cr content based on 100 parts by weight of sulfide inclusions formed in the said steels is 10–50 parts by weight.

The second aspect of the present invention is to provide machinable ferrite stainless steels consisting of not more than 0.030% of C, not more than 0.050% of N, not more than 0.012% of O, not more than 0.8% of Si, not more than 1.6% of Mn, 0.05–0.40% of S, 16–22% of Cr, 1–3% of Mo, and at least one of 0.03–0.25% of Pb, 0.03–0.20% of Se and 0.01–0.15% of Te, the remainder being Fe, provided that the sum of C and N is not more than 0.060% and Mn/S is 2–5, characterized by that Cr content in sulfide inclusions formed in the said steels based on 100 parts by weight of said inclusions is 10–50 parts by weight.

Then, the reason for limiting the composition of the alloy components in the steels of the present invention will be explained hereinafter.

Since C and N are austenite forming elements, C and N must be small amounts, that is not more than 0.03% and not more than 0.05% respectively and the sum of C and N must be not more than 0.060% in order to improve the corrosion resistance and formability as a ferrite stainless steels.

Oxygen must be not more than 0.012% in order to form the sulfide inclusions and improve the tool life and the corrosion resistance.

Si is added together with Mn as the deoxidizing element but the formation of $MnO\text{-}Cr_2O_3$ inclusion desirable for improvement of the corrosion resistance becomes few, so that Si must be not more than 0.8%.

Mn is added together with Si as the deoxidizing element and is the element which forms the sulfide inclusion, such as (Mn, Cr)S and contributes to improve the machinability, but when Mn becomes more than 1.6%, the corrosion resistance is apt to lower, so that such an amount is not desirable and Mn must be not more than 1.6%.

Cr is desired to be contained in an amount of at least 12% in order to surely obtain the corrosion resistance against organic acids, inorganic acids and the like and in the Cr composition range corresponding to the base component of 18Cr-2Mo steel, the characteristics of the steels of the present invention are developed, so that Cr must be within the range of 16–22%.

Furthermore, Cr in the sulfide inclusions must be contained in an amount of not less than 10% in order to maintain the corrosion resistance of the steels of the present invention but when Cr exceeds 50%, the corrosion resistance of the steels lowers and the cutting tool life lowers, so that said amount must be 10–50 parts by weight based on 100 parts by weight of the inclusion.

Mo is the ferrite forming element together with Cr and stabilizes the passive state of the stainless steel and increases the corrosion resistance, so that it is desired that Mo is contained in an amount of more than 0.5% and the characteristics of the steels of the present invention are developed within the composition range corresponding to 18Cr-2Mo steel, so that Mo must be within the range of 1–3%.

S is the element which forms the sulfide inclusions, such as (Mn, Cr)S and improves the machinability and when the amount is less than 0.05%, the machinability is not improved, while when the amount is larger than 0.4%, the corrosion resistance lowers, so that S must be within the range of 0.05–0.4%.

In the range where the amount of Mn is not more than 1.6% and the amount of S is 0.05–0.40% in 18Cr-2Mo steel, as Mn/S ratio becomes less than 2, the sulfide inclusions, such as CrS form and it is difficult to form the sulfide inclusions containing 10–50 parts by weight of Cr in 100 parts by weight of the inclusion, such as (Mn, Cr)S and the improvement of the corrosion resistance can not be obtained. On the other hand, as Mn/S ratio becomes more than 5, sulfide inclusions, such as MnS are formed and the formation of the sulfides, such as (Mn, Cr)S becomes difficult. In view of this point, Mn/S ratio must be within the range of 2–5.

Pb bonds to the inclusion present in the said steel, such as (Mn, Cr)S to form (Mn, Cr)S+Pb inclusion, whereby the machinability and the lubricating function between the tool and the chips are improved and Pb contributes to elongate the tool life but when Pb is less than 0.03%, the improvement of the tool life is not attained, while when Pb is more than 0.25%, the toughness and hot workability of the said steels lower, so that Pb must be 0.03–0.25%.

Se bonds to (Mn, Cr)S inclusion in the said steels to form (Mn, Cr) (S, Se) inclusion and to improve the tool life, but when Se is less than 0.03%, the effect is low, while when Se is more than 0.20%, the toughness and hot workability of the steel lower, so that Se must be 0.03–0.20%.

Te bonds to (Mn, Cr)S inclusion in the said steels to form (Mn, Cr)S+MnTe inclusion and to improve the tool life, but when Te is less than 0.01%, the tool life is not improved, while when Te is more than 0.15%, the toughness and workability of the said steels lower, so that Te must be 0.01–0.15%.

The present invention will be explained in more detail.

Figure 2:
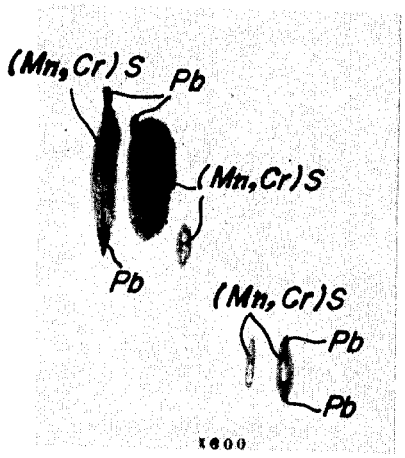
Figure 3:
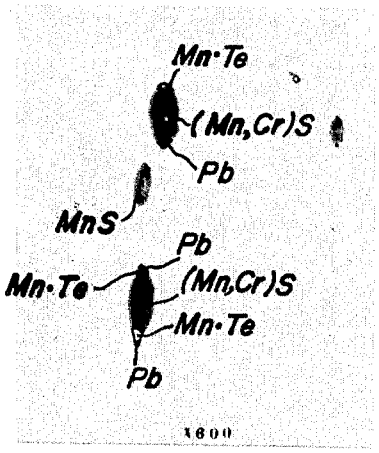

For a better understanding of the invention, reference is taken to the accompanying drawings, wherein:

FIG. 1 is a microphotograph of the sulfide inclusion of Comparative Sample No. 7, and FIGS. 2 and 3 are microphotographs of the sulfides of Samples C and G according to the present invention respectively.

The invention will be concretely explained with respect to the experimental data.

The steels shown in the following Table 1 according to the present invention were produced as follows.

The deoxidation was effected by using Si and Mn while maintaining Pco partial pressure in a furnace at lower than 0.01 atm in an argon plasma arc melting furnace for experiment to produce 18Cr-2Mo molten steel containing very slight amounts of C, O and N and then S of such an amount that Mn/S ratio is adjusted within the range of 2–5 based on the analytical value of the alloy components of the molten steel, was added thereto or further the above defined amounts of Pb, Se and Te were added, after which the molten steel was rapidly cast to form (Mn, Cr)S+Pb, (Mn, Cr) (S, Se) and (Mn, Cr)S+MnTe inclusions containing 10–50% of Cr in the inclusions.

The cast ingots were hot rolled at the temperature range of 1,250°–1,000° C. and annealed by cooling in air at 800° C.±50° C.×3 hr to adjust the hardness (HB) within the range of 160±5.

The chemical component and the inclusion composition of each sample is shown in the following Table 1.

Table 1(a)

| Sample | | No. | Chemical Components C \| N (C+N) | O | Si | Mn \| S (Mn/S) | Ni | Cr | Mo | Others | (Mn,Cr)S including Composition Mn | S | Cr | Fe | Others |
|---|---|---|---|---|---|---|---|---|---|---|---|---|---|---|---|
| Comparative | SUS 430F | 1 | 0.081\|0.040 (0.121) | 0.013 | 0.42 | 0.62\|0.290 (2.1) | — | 17.12 | — | — | 29 | 35 | 30 | 4 | 2 |
| | SUS 304 | 2 | 0.062\|0.032 (0.094) | 0.012 | 0.45 | 0.72\|0.014 (51.4) | 8.51 | 18.42 | — | — | 59 | 36 | 4 | 2 | 1 |
| | SUS 303 | 3 | 0.074\|0.056 (0.130) | 0.013 | 0.33 | 1.56\|0.253 (6.2) | 9.11 | 17.30 | — | — | 59 | 35 | 3 | 2 | 1 |
| | 18Cr-2Mo | 4 | 0.015\|0.028 (0.043) | 0.012 | 0.50 | 0.95\|0.010 (95.0) | — | 18.75 | 2.75 | — | 55 | 36 | 5 | 2 | 2 |
| | | 5 | 0.012\|0.023 (0.035) | 0.010 | 0.46 | 0.99\|0.009 (110.0) | — | 18.79 | 2.71 | Pb 0.14 | 53 | 38 | 5 | 3 | 1 |
| | | 6 | 0.010\|0.045 (0.055) | 0.008 | 0.45 | 0.98\|0.010 (98.0) | — | 18.37 | 2.57 | Te 0.052 | 55 | 40 | 2 | 2 | 1 |
| | | 7 | 0.013\|0.038 (0.051) | 0.007 | 0.51 | 1.72\|0.220 (7.8) | — | 18.46 | 2.23 | — | 54 | 39 | 4 | 2 | 1 |
| | | 8 | 0.015\|0.032 (0.047) | 0.013 | 0.48 | 0.30\|0.301 (1.0) | — | 18.03 | 2.12 | — | 5 | 37 | 54 | 3 | 1 |
| Present invention | First aspect | A | 0.017\|0.033 (0.050) | 0.008 | 0.23 | 0.35\|0.168 (2.1) | — | 18.53 | 2.54 | — | 29 | 35 | 31 | 3 | 2 |
| | | B | 0.010\|0.020 (0.030) | 0.006 | 0.34 | 0.65\|0.216 (3.0) | — | 18.81 | 2.12 | — | 38 | 37 | 22 | 2 | 1 |

Table 1(b)

| Sample | No. | Chemical Components C \| N (C+N) | O | Si | Mn \| S (Mn/S) | Ni | Cr | Mo | Others | (Mn,Cr)S including Composition Mn | S | Cr | Fe | Others |
|---|---|---|---|---|---|---|---|---|---|---|---|---|---|---|
| | C | 0.015\|0.034 (0.049) | 0.007 | 0.33 | 0.58\|0.252 (2.3) | — | 19.10 | 2.06 | Pb 0.08 | 31 | 38 | 27 | 2 | 2 |
| | D | 0.008\|0.030 (0.038) | 0.006 | 0.39 | 0.78\|0.296 (2.6) | — | 18.40 | 2.57 | Pb 0.16 | 35 | 37 | 25 | 2 | 1 |
| | E | 0.016\|0.020 (0.036) | 0.008 | 0.54 | 0.89\|0.278 (3.2) | — | 18.88 | 2.36 | Te 0.025 | 43 | 34 | 20 | 2 | 1 |
| | F | 0.020\|0.025 (0.045) | 0.010 | 0.48 | 0.86\|0.390 (2.2) | — | 18.51 | 2.50 | Te 0.053 | 33 | 32 | 31 | 1 | 2 |

Table 1(b)-continued

| Sample | | No. | Chemical Components C \| N (C+N) | O | Si | Mn \| S (Mn/S) | Ni | Cr | Mo | Others | (Mn,Cr)S including Composition Mn | S | Cr | Fe | Others |
|---|---|---|---|---|---|---|---|---|---|---|---|---|---|---|---|
| Present Invention | Second aspect | G | 0.009\|0.017 (0.026) | 0.006 | 0.33 | 0.71\|0.189 (3.6) | — | 19.50 | 2.11 | Pb 0.14 Te 0.045 | 44 | 38 | 16 | 1 | 1 |
| | | H | 0.016\|0.026 (0.042) | 0.008 | 0.42 | 0.67\|0.301 (2.2) | — | 18.27 | 2.63 | Pb 0.07 Te 0.061 | 27 | 36 | 32 | 3 | 2 |
| | | K | 0.012\|0.038 (0.050) | 0.010 | 0.36 | 0.80\|0.276 (2.9) | — | 19.38 | 2.32 | Se 0.12 | 40 | 24 | 22 | 2 | 12 |
| | | L | 0.020\|0.035 (0.055) | 0.009 | 0.40 | 0.68\|0.285 (2.4) | — | 18.84 | 2.21 | Pb 0.07 Te 0.029 | 33 | 35 | 28 | 2 | 2 |

The composition of the inclusion shown in the above table is the value obtained by preparing each sample by cutting with emery, embedding the cut sample in a resin, grinding said sample with a paper cloth and then identificating only the inclusion by X-ray microanalyser.

Concerning the shape of the inclusions shown in the above table, for example in Sample No. 7, MnS inclusion having the shape as shown in the microphotograph (all magnifications in the following photographs are 600 times) of FIG. 1 was formed. In sample C, (Mn, Cr)S+Pb inclusion having the shape as shown in the microphotograph of FIG. 2, wherein Pb grain is bonded to (Mn, Cr)S was formed. In sample G, (Mn, Cr)S+Pb+MnTe inclusion as shown in the microphotograph of FIG. 3, wherein Pb grain and MnTe grain bond to (Mn, Cr)S, was formed.

These samples were subjected to the following corrosion resistant tests and the decreased amounts due to the corrosion are shown in the following Table 2.

(1) Resistant test against sulfuric acid when immersed in 5% boiled sulfuric acid solution for 6 hours.

(2) Nacl aqueous solution spraying test when 5% Nacl aqueous solution at 35° C. was continuously sprayed for 96 hours.

(3) Pitting corrosion test when immersed in ferric chloride solution ($FeCl_3 6H_2O$:50 g/l) at 35° C.

When synthesizing the test results, the corrosion resistance of the steels of the present invention is superior to those of SUS 430F and SUS 303 and the pitting corrosion resistance of the steels of the present invention is superior to that of SUS 304.

From contrast of these facts and the data of the corrosion resistance and the tool life of the samples in Table 2 with Table 1, it can be seen that as compared with Sample No. 7 wherein MnS inclusion has been formed, Sample No. C wherein (Mn, Cr)S+Pb inclusion containing more than 10% of Cr is formed, is superior in the corrosion resistance and the tool life and in particular, the corrosion resistance is equal to or higher than that of Sample Nos. 4.5 and 6 wherein S content is lower. In Sample No. G, the drill life is improved.

Table 2(a)

| | Sample | No. | Corrosion test against 5% boiled sulfric acid solution ($g/m^2/hr$) | 5% Nacl aqueous solution spray test Result | Pitting corrosion resistance (350° C., ferric chloride solution) ($g/m^2/hr$) | Cutting tool life index, tool life of sample/tool life of No. 4 | Drill tool life index, tool life of sample/ tool life of No. 4 |
|---|---|---|---|---|---|---|---|
| | SUS 430F | 1 | >2,000 | C | 220 | 1.25 | 95 |
| | SUS 304 | 2 | 85 | A | 35.3 | 0.83 | 0.4 |
| | SUS 303 | 3 | 950 | B | 75.1 | 1.21 | 60 |
| Comparative | | 4 | 831 | B | 6.55 | 1.00 | 1.00 |
| | | 5 | 501 | B | 6.89 | 1.15 | 15 |
| | 18Cr-2Mo | 6 | 822 | B | 7.92 | 1.10 | 7 |
| | | 7 | 1,470 | C | 10.38 | 1.65 | 120 |
| | | 8 | 1,270 | B | 18.31 | 0.91 | 106 |

Table 2(b)

| | Sample | No. | Corrosion test against 5% boiled sulfric acid solution ($g/m^2/hr$) | 5% Nacl aqueous solution spray test Result | Pitting corrosion resistance (350° C., ferric chloride solution) ($g/m^2/hr$) | Cutting tool life index, tool life of sample/tool life of No. 4 | Drill tool life index, tool life of sample/ tool life of No. 4 |
|---|---|---|---|---|---|---|---|
| | First aspect | A | 869 | B | 7.05 | 2.18 | 130 |
| | | B | 925 | B | 7.52 | 2.51 | 250 |
| | | C | 625 | B | 7.86 | 3.12 | 2,060 |
| | | D | 585 | B | 7.46 | 3.36 | 2,320 |
| Present | | E | 885 | B | 8.21 | 2.90 | 1,200 |

Table 2(b)-continued

| Sample | | No. | Corrosion test against 5% boiled sulfric acid solution ($g/m^2/hr$) | 5% Nacl aqueous solution spray test Result | Pitting corrosion resistance (350° C., ferric chloride solution) ($g/m^2/hr$) | Cutting tool life index, tool life of sample/tool life of No. 4 | Drill tool life index, tool life of sample/tool life of No. 4 |
|---|---|---|---|---|---|---|---|
| Invention | Second aspect | F | 880 | B | 8.01 | 2.98 | 1,520 |
| | | G | 500 | B | 7.80 | 3.59 | >5,000 |
| | | H | 512 | B | 8.12 | 3.43 | >5,000 |
| | | K | 830 | B | 7.15 | 3.05 | 1,720 |
| | | L | 539 | B | 7.69 | 3.21 | >5,000 |

Table 3

| Turning Test | | Drilling Test | |
|---|---|---|---|
| Tool | M10, 33-2 (0, 6, 6, 6, 15, 15, 02R) | Tool | Straight shank drill 5.0 mm diameter |
| Depth of cut | 1.0 mm | Revolution | 1,500 r.p.m. |
| Feed | 0.15 mm/rev | Feed | 0.15 mm/rev |
| Cutting speed | 200 mm/min | Depth of drilling | 20 mm |
| Cutting oil | No | Cutting oil | No |
| Tool life Judgement | VB = 0.1 mm | Tool life Judgement | Tool was melted and damaged |

For production of the stainless steels of the present invention, any conventional processes of making steel may be used.

In order to make the amount of C, N and O in the steels prior to addition of S, Pb, Se and Te smaller, it is advantageous to adopt the methods for steel making, for example AOD, VOD, VAD or PIF.

As mentioned above, 18Cr-2Mo type of ferrite stainless steels according to the present invention wherein the sulfide inclusion containing 10–50% of Cr has been formed have the same or higher corrosion resistance then the conventional 18Cr-2Mo type of ferrite stainless steels wherein the sulfide inclusions containing less than 10% of Cr, and are for more excellent in the machinability and the broad application is expected as the industrial structural materials.

What is claimed is:

1. Machinable ferrite stainless steels consisting of not more than 0.030% of C, not more than 0.050% of N, not more than 0.012% of O, not more than 0.8% of Si, not more than 1.6% of Mn, 0.05–0.40% of S, 16–22% of Cr, 1–3% of Mo, the remainder being Fe, provided that the sum of C and N is not more than 0.060% and Mn/S is 2–5, characterized in that Cr content based on 100 parts by weight of sulfide inclusions formed in the said steels is 10–50 parts by weight.

* * * * *